United States Patent [19]

Wormser

[11] Patent Number: 4,499,857

[45] Date of Patent: Feb. 19, 1985

[54] FLUIDIZED BED FUEL BURNING

[75] Inventor: Alex F. Wormser, Marblehead, Mass.

[73] Assignee: Wormser Engineering, Inc., Woburn, Mass.

[21] Appl. No.: 542,646

[22] Filed: Oct. 17, 1983

[51] Int. Cl.[3] ..... F22B 1/02

[52] U.S. Cl. ..... 122/4 D; 110/186; 110/188; 122/449; 236/14

[58] Field of Search ..... 122/4 D, 448 R, 449; 110/186, 188; 236/14

[56] References Cited

U.S. PATENT DOCUMENTS

| | | | |
|---|---|---|---|
| 4,003,342 | 1/1977 | Hodgson | 236/14 X |
| 4,253,404 | 3/1981 | Leonard | 110/188 |
| 4,279,205 | 7/1981 | Perkins et al. | 122/4 D X |
| 4,335,683 | 6/1982 | Criswell et al. | 122/4 D |
| 4,362,269 | 12/1982 | Rastogi et al. | 110/188 X |
| 4,416,418 | 11/1983 | Goodstine et al. | 122/4 D X |

*Primary Examiner*—Edward G. Favors

[57] ABSTRACT

Controlling a fluidized bed coal combustor by sensing certain variables and thereby controlling other variables.

4 Claims, 1 Drawing Figure

FLUIDIZED BED FUEL BURNING

FIELD OF THE INVENTION

This invention relates to burning and desulfurizing fuel, particularly coal, using fluid bed combustors.

BACKGROUND OF THE INVENTION

Some related background is set forth in U.S. Pat. No. 4,135,885, "Burning and Desulfurizing Coal", the contents of which are herein incorporated by reference. Further related background and disclosures are set forth in U.S. Pat. Nos. 4,279,207, 4,279,205, and in 4,303,023, the contents of all of which are hereby incorporated by reference herein.

SUMMARY OF THE INVENTION

I have discovered that combustion control may be advantageously carried out, with greatly improved range of turndown or turnup and greatly increased speed of turndown or turnup, all while maintaining combustion bed temperatures very near that optimum for efficiency, by using at least one burning process variable parameter as a control for at least another burning process variable parameter.

In a preferred embodiment, steam pressure controls volume of primary air input, volume of primary air input controls quantity of coal input, bed temperature controls bed solids level relative to steam tubes, the sulfurizing bed temperature controls secondary air supply, and a sulfur dioxide sensor enables control of the ratio of limestone to coal.

DESCRIPTION OF THE PREFERRED EMBODIMENT

Figure 1:
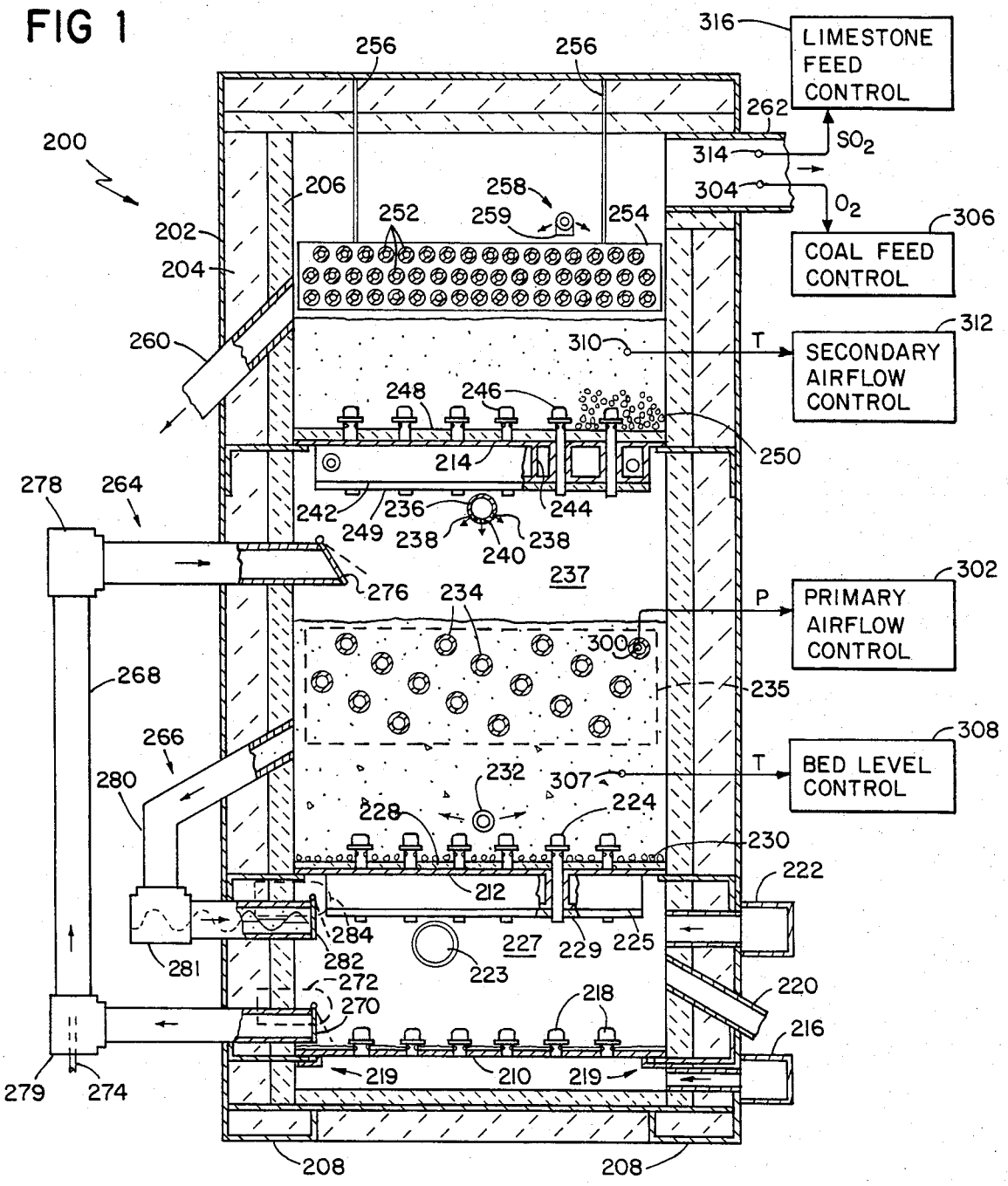
FIG. 1 is a diagrammatic view, mainly in section, of the most preferred embodiment of the invention.

I turn to description of the structure and then operation of the embodiment of FIG. 1.

Structure

There is shown in FIG. 1, diagrammatically, a three-bed all fluidized, combustor-desulfurizer, indicated generally at 200. A metal housing 202 surrounds layers 204 and 206 of lower and higher density refractory, respectively, to enclose the entire unit, which rests on supports 208. Metal distributor plates 210, 212, and 214 extend across the housing interior to define the bottoms, respectively, of three fluidized beds—a lower bed for storing sand, a middle combustor bed, and an upper desulfurizer bed.

The lower sand storage bed has under it a plenum fed by a windbox 216, through which fluidizing air enters the bed underneath distributor plate 210. A multiplicity of bubble caps 218 extend through plate 210 (over which extends an insulating board, not shown, to avoid hot spots), which is held in place by expandable joints 219. Extending through the housing wall above caps 218 is coarse-ash disposal pipe 220, which carries away to a baghouse hopper excess bed material.

The middle combustor bed has under it plenum 222 for supplying fluidizing combustion air to the middle bed. A multiplicity of bubble caps 224 extend through distributor plate 212 and water jacket 225, which serves to cool plate 212 to prevent it from buckling. A layer of insulation 228 rests on plate 212 surrounding each of caps 224, and a layer of stone 230 (actually coarse quartz in a mix of sizes from $\frac{3}{8}''$ to 1" in diameter) covers insulation 228. A similar layer of insulation 229 is secured (by means not shown) to the bottom of water jacket 225. The insulation serves to cut heat loss to the water in jacket 225. Above bubble caps 224 is coal feed pipe 232, which deposits coal at the bottom of the combustor bed, just above bubble caps 224. (Under-the-bed feeding of the coal allows the use of coal fines in the feed which would otherwise, i.e., with over-the-bed feeding, be blown out of the bed without combusting. Over-the-bed feeding would also make it difficult to operate the bed in any but its full-on position, i.e., with sand covering the top of steam tubes 235. At lower sand levels, with over-the-bed feeding, the coal would fall onto the steam tubes, and an agglomeration of unburned coal would soon build up. The inability to operate at reduced sand levels in the middle bed would eliminate use of the preferred turndown and startup methods, as will be described.)

Above pipe 232 and extending across the combustor bed are steam tubes 234, which are mounted at their ends in tube sheets 235 (one shown in broken lines) that define manifolds for introducing water into the tubes and removing water and steam from them. Tubes 234 are spaced and occupy 25% of the housing volume in the zone from the top row of tubes to the bottom row.

The upper desulfurizer bed has under it apertured secondary air pipe 236, which has two rows of holes 238 inclined downwardly at 30° for spreading out the secondary air beneath the upper bed and a third row of holes 240 at the bottom of the pipe for blowing out any particles that may have gotten into the pipe. Above pipe 236 is water jacket 242, which serves to cool distributor plate 214 to prevent it from buckling. Baffles 244 (one shown) serve to keep the velocity of the circulating cooling water high enough to avoid local hot spots that might cause damage. A multiplicity of bubble caps 246 extend through jacket 242 and plate 214. A layer of insulation 248 rests on plate 214 surrounding each of caps 246, and a layer of stones 250 (the same materials as stones 230) covers insulation 248 and caps 246. A similar layer of insulation 249 is secured to the bottom of water jacket 242. The insulation serves the same purposes as that for the middle bed distributor and water jacket. (The purpose of the stones 250 is to allow the gases emerging from bubble caps 246 to spread laterally over the distributor, allowing them to emerge into the upper bed at a sufficiently low velocity to avoid shattering the limestone particles.) Above the upper bed are three rows of tubes 252 to deflect particles back into the bed. Each tube in the middle row is positioned directly above a corresponding tube in the bottom row, but each of the tubes in the top row is positioned halfway between each adjacent pair of vertical pitch lines for the lower two rows. This arrangement avoids the possibility of a line of sight opening at any angle through the tubes so any particle that is ejected from the bed will solidly contact one of the tubes before leaving the bed, thereby reducing its speed and the likelihood of splashing into the freeboard. (A similar bank of tubes may usefully be placed above the second—i.e., combustion—bed.) Tubes 252 are supported near their ends and at spaced positions longitudinally thereof by apertured sheets 254 (only one shown), which are in turn supported from housing 202 by rods 256. Above tubes 252 extends limestone feed pipe 258, which deposits limestone in the desulfurizer bed to a level just above the top row of tubes 252. The limestone drops from the outlet tee 259 of pipe 258 through a gap (not shown) in the assembly of tubes 252; without the gap, some limestone particles may be too large to pass through the tube assembly. Limestone downcomer 260 cooperates with a limestone pot to maintain the level of limestone just above tubes 252 and to carry away spent limestone. Hot desulfurized gases leave through smoke pipe 262, through which they can be transported through a boiler to which they give up their remaining heat, then to a baghouse for removal of any ash or other particulates that may escape from the upper bed, and finally to a stack.

Upcomer assembly 264 and downcomer assembly 266 permit bed material to be moved from the lower bed to the middle bed and vice versa, for preheating and turndown (both to be discussed in more detail subsequently). Upcomer assembly 264 includes upcomer piping 268, which, when door 270 is opened by actuator 272 (shown in broken lines because it is mounted on the exterior of housing 202), permits bed material to be taken from the lower bed and blown by air under pressure from tube 274 into the middle bed through door 276, which is held shut by gravity to prevent filling up of the upcomer piping with bed material when it is not in use but which opens in response to bed material forced up from the lower bed. The normal bed material level for operating the combustor at 100% of capacity is just above the topmost steam tubes, as shown in FIG. 1. Tee fittings 278 and 279 are used when the bed material makes a sharp turn, to reduce wear on the piping there.

Downcomer assembly 266 includes downcomer piping 280, which, when door 282 is opened by actuator 284 (shown in broken lines because it is mounted on the exterior of the housing), permits bed material that has entered the piping from the middle bed to be fed with a feed screw into the lower bed. For normal operation downcomer piping 280 should be filled with bed material to act as a pressure seal so that air from plenum 227 is not able to keep bed material from coming down the piping. Tee fitting 281 is positioned where the bed material makes a sharp turn.

Operation

Sand sized at about 20 mesh (850μ) is supplied to fill the middle bed to a depth of about 11.5". Type 1360 limestone crushed to a mean particle diameter of 20 mesh (850μ) is supplied through feedpipe 258 to fill the upper bed to a depth of about 6".

Start-up of a cold combustor requires preheating as follows. Fluidizing air is supplied from a blower (not shown) through windbox 216, and the middle bed, assuming that it has been previously filled with bed material, is emptied via downcomer assembly 266 until the bed level is below the inlet to the downcomer so that boiler tubes 234 are no longer covered with bed material (remaining material is about 6" deep). Air from the windbox 216 passing through bubble caps 218 acts to spread out the bed material deposited by the downcomer, and directed through the storage bed when either the upcomer or downcomer is in operation, to keep the lower bed material uniformly spread out. When the bed level in the middle bed is down to 6 inches, the fluidizing air is turned off. The water circulator pump for pumping water through tubes 234 is turned on. Preheater 223, which is spaced below distributor 212 to provide uniform heating of the middle bed, is then turned on. Flames generated in the preheat burner are cooled to approximately 1700° F. by secondary air before they emerge from the burner, to avoid overheating bubble caps 224. Hot gases emerging from the preheat burner 223 heat the material in the middle bed to about 1000° F. in about an hour, following which coal is added for a minute with fluidization (to assist further preheating), following which preheating is resumed 15 minutes or so, until the bed reaches about 1350° F. Because the boiler tubes are not in contact with material in the middle bed, they do not draw heat from the bed material, and because the bed material is heated when it is not being fluidized (i.e., as a fixed bed), the surface area for heat loss from the bed material is reduced, so that the bed material can be heated with a fairly small preheater.

When the middle bed has reached 1350° F., the propane-fired preheater is turned off. Fluidizing combustion air from the blower is supplied through windbox 222 and through bubble caps 224 to fluidize the middle bed. The fluidizing combustion air is controlled by a valve (not shown) to provide an airflow of 100 scfm per square foot of bed area, which produces a superficial velocity of approximately 7½ f/sec. in the upper bed at 1550° F. The coal feed screw and transport air compressor (not shown) feeding air to the coal pot at the inlet pipe and to the limestone rotary feeder outlet (not shown) are then started, and coal is fed from a bin (not shown) through a screw feeder, a drier, a crusher, a rotary air lock, and a coal pot (all not shown), and to the middle bed through pipe 232. The coal mixes with the hot bed material and burns. Fluidization causes the coal to be distributed away from the coal feed pipe and become mixed throughout the bed. The heat released from the burning coal heats the bed, until the middle bed approaches the desired temperature of 1800° F.

Pressure sensor 300 for the steam pressure at the common exit of steam tubes 234 is electrically connected to airflow controller 302 which controls a damper (not shown) regulating the amount of primary air introduced through plenum 222. If the sensor 300 calls for more steam pressure than exists, said damper is opened, commensurately, introducing more primary air through plenum 222 and bubble caps 224. This in turn splashes more solids against steam tubes 234, to facilitate increased heat exchange.

At the same time through a second control loop, oxygen sensor 304 placed in the stack is electrically connected to coal feed controller 306, which increases coal feed through pipe 232 commensurately with increased air feed so that excess air is maintained at a constant efficient amount (say 20%).

Each of the changes effected by both of the control loops just described is virtually instantaneous.

In a further loop, there is provided combustion bed temperature sensor 307, which is electrically connected to bed level control 308, controlling downcomer assembly 266 and upcomer assembly 268. If temperature rises unduly, indicating inadequate solids-steam tubes heat transfer, temperature sensor 308 acts to cause movement of solids into the zone, to increase solids available for splashing against steam tubes.

Finally are provided two subsidiary loops.

In one of the subsidiary loops, thermocouple 301 is placed in the upper bed and is electrically connected to secondary airflow control 312, which controls a valve (not shown) regulating the amount of secondary air introduced through pipe 236, to control the upper bed at the desired temperature lower than that of the middle bed.

In the other secondary loop, sulfur dioxide sensor 314 is located in the stack and is electrically connected to limestone feed control 316, which makes possible matching the limestone:coal ratio to that previously calculated as desirable in order to maintain desired system parameters.

Other embodiments within the scope of the following claims will be apparent to those skilled in the art. For example, loop organization could be changed so that the burning parameters sensed are different and the burning parameters controlled by what is sensed are different.

What is claimed is:

1. A method of burning coal comprising burning coal in a first fluidized bed chamber having tubes carrying steam heated therein, said tubes not being covered when said bed is not fluidized and being covered when said bed is fully fluidized, treating the gaseous products of combustion from said first fluidized bed in a second fluidized bed to provide a treated stack gas, controlling the rate of airflow into said first fluidized bed based upon the pressure of steam in said tubes, controlling the ratio of the rate of airflow to the rate of feeding coal based upon the concentration of oxygen in said stack gas, and controlling the level of solids in said first fluidized bed based upon the combustion bed temperature in said first fluidized bed.

2. A method of burning coal comprising burning coal in a first fluidized bed chamber having tubes carrying steam heated therein, said tubes not being covered when said bed is not fluidized and being covered when said bed is fully fluidized, controlling the rate of airflow into said first fluidized bed based upon the pressure of steam in said tubes, controlling the ratio of the rate of air flow to the rate of feeding coal based upon the concentration of oxygen in said stack gas, and controlling the level of solids in said first fluidized bed based upon the combustion bed temperature in said first fluidized bed.

3. The method of claim 1 in which a temperature sensor in the second bed regulates the rate of flow of secondary air.

4. The method of claim 1 in which a sulfur dioxide sensor is provided in the stack.

* * * * *